US010632344B2

(12) United States Patent
Snell et al.

(10) Patent No.: US 10,632,344 B2
(45) Date of Patent: Apr. 28, 2020

(54) SWIM TRAINING APPARATUS FOR BILATERAL UNDULATION POWER DEVELOPMENT

(71) Applicant: Aquatic Research and Training Technology LLC, Meansville, GA (US)

(72) Inventors: Eric Jeffery Snell, Meansville, GA (US); Bethany Christine Tilson, Meansville, GA (US); Jackson Lee Snell, Meansville, GA (US)

(73) Assignee: AQUATIC RESEARCH AND TRAINING TECHNOLOGY LLC, Meansville, GA (US)

( * ) Notice: Subject to any disclaimer, the term of this patent is extended or adjusted under 35 U.S.C. 154(b) by 0 days.

(21) Appl. No.: 15/938,046

(22) Filed: Mar. 28, 2018

(65) Prior Publication Data

US 2018/0280764 A1 Oct. 4, 2018

Related U.S. Application Data

(60) Provisional application No. 62/478,293, filed on Mar. 29, 2017.

(51) Int. Cl.
*A63B 31/11* (2006.01)

(52) U.S. Cl.
CPC ..... *A63B 31/11* (2013.01); *A63B 2031/117* (2013.01); *A63B 2244/20* (2013.01)

(58) Field of Classification Search
CPC ..... B63H 16/08; B63H 16/00; A63B 31/00; A63B 31/12; A63B 31/11; A63B 31/08; A63B 35/00; A63B 35/02
USPC ..... 440/13, 14, 15, 21; 441/55, 60, 64
See application file for complete search history.

(56) References Cited

U.S. PATENT DOCUMENTS

| | | | | |
|---|---|---|---|---|
| 1,530,560 | A * | 3/1925 | Heminger | A63B 35/02 441/55 |
| 4,781,637 | A | 11/1988 | Caires | |
| 4,828,521 | A | 5/1989 | Harrington | |
| 4,905,991 | A | 3/1990 | Alston | |
| 4,923,418 | A | 5/1990 | Hoffman | |
| 5,649,845 | A | 7/1997 | Fetchner | |
| 5,667,466 | A | 9/1997 | Riley, Jr. | |
| 6,375,530 | B1 | 4/2002 | Earl | |

(Continued)

FOREIGN PATENT DOCUMENTS

| | | | |
|---|---|---|---|
| GB | 2317838 | A | 4/1998 |
| JP | 2012239852 | A | 12/2012 |

OTHER PUBLICATIONS

PINTEREST, "Finswimming", https://i.pinimg.com/originals/c7/55/db/c755db4e04a855533b4abd609a592d85.jpg.
DOL-Fin Dynamic Oscilating Lateral Fin; 2015, Smith Aerospace.

*Primary Examiner* — Lars A Olson
(74) *Attorney, Agent, or Firm* — Kim IP Law Group PLLC

(57) ABSTRACT

A swim training apparatus for use as a monofin for bilateral undulation power development. The apparatus includes a flexible, elongated member having a series of securing members, such as through-holes extending from the top surface of the elongated member through to its bottom surface, and fasteners configured and disposed to attach to the securing member, such as straps that can extend through the through-holes, to fasten the apparatus to a user's legs. A weight can be attached using similar attachments and fasteners to the apparatus to increase undulation during use.

18 Claims, 3 Drawing Sheets

(56) References Cited

U.S. PATENT DOCUMENTS

| | | | |
|---|---|---|---|
| 6,764,362 | B1 | 7/2004 | Wenzel |
| 7,354,385 | B2 | 4/2008 | Virji et al. |
| 8,246,404 | B1 | 8/2012 | Sweet |
| 8,475,344 | B1 | 7/2013 | Lutz |
| 8,632,372 | B2 | 1/2014 | Fleck |
| 8,678,870 | B2 | 3/2014 | Johnson |
| 9,707,431 | B1 | 7/2017 | Haley |
| 2005/0176315 | A1 | 8/2005 | Lundquist |
| 2011/0250818 | A1 | 10/2011 | Geurts |
| 2012/0252289 | A1 | 10/2012 | Johnson |
| 2014/0199902 | A1 | 7/2014 | Suciu |
| 2017/0151465 | A1 | 6/2017 | Browning et al. |

* cited by examiner

SWIM TRAINING APPARATUS FOR BILATERAL UNDULATION POWER DEVELOPMENT

CROSS-REFERENCE TO RELATED APPLICATIONS

This application claims the benefit of U.S. Provisional Application Ser. No. 62/478,293, filed Mar. 29, 2017, the entire disclosure of which is incorporated herein by reference in its entirety for all purposes.

FIELD OF THE INVENTION

The present invention relates to a swim training apparatus, particularly a monofin swim apparatus designed for aquatic training.

BACKGROUND OF THE INVENTION

Monofins for various aquatic functions, ranging from cosmetic costumes to swimming aids, have been common in aquatic industries for years. Conventional monofins consist of a single fin attached to the user, and usually to the user's feet or legs. When attached to a user, a monofin can increase the propulsion force generated by a user while swimming by increasing the surface area of their kick cycle and by simulating the motions of a dolphin.

However, in aquatic activities where such equipment may not always be used, such as competitive swimming, monofins can actually be harmful to a swimmer's technique, since some monofins increase the efficiency of the user's kick cycle only by increasing the surface area of the user's effective kick. Training in this way fails to address and may even hamper proper kicking technique. Furthermore, many monofins and similar devices known in the art are only designed to function on or near the surface of a body of water. Currently, the aquatic aids and devices industry generally lacks a device capable of training for technique purposes, especially when the user is submerged under water.

When a swimmer is fully submerged underwater, the undulation of the swimmer's kick can be described in two phases. The first phase, termed the propulsive phase, is typified by the legs moving forward from behind the swimmer's prostrate horizontal midline. The second phase is termed the recovery phase This phase of motion is typified by the swimmer's legs returning from the front of the swimmer's midline to the back of the swimmer and the origin of the propulsive phase. While the recovery phase is substantially less powerful that the propulsive phase, maximizing the efficiency of both phases can be crucial to maximizing the speeds of competitive swimmers. Both phases are vital for the underwater undulation of a swimmer. An example of when this technique is pivotal to maximizing a swimmers efficiency is when the swimmer changes directions at a wall, an event known as a flip turn.

While it is substantially easier to achieve efficient power in the propulsive phase, the recovery phase can often be more difficult from a training perspective. The power from the recovery phase can be greatly improved when the swimmer's knees and ankle are straight. Previously known devices encourage and often require the user's ankles to bend and lose power, which consequently inhibits most effective swimming techniques and instead encourages inefficient techniques for unaided swimming.

A common problem for many swimmers, even those who are highly advanced, is a lack of a bilateral underwater kick. After kicking forward from behind the body, many swimmers do not extend the kick beyond the midline of the body. This bilateral motion is neglected in the use of conventional monofins, but is essential for competitive technique training. The foregoing disclosure details the first ever device that trains users to achieve this bilateral undulation of the legs while kicking in order to stimulate muscular development in both the power and return cycle of the kick, as well as train users to kick bilaterally. By feeling the undulating movement of the weight on the flexible, elongated member, the swimmer has to undulate fully in equal degrees to the front and back of the midline.

BRIEF SUMMARY OF THE INVENTION

In accordance with the present invention, there is provided a swim training apparatus for training bilateral undulation power development. In one exemplary embodiment of the present invention, the swim training apparatus is a monofin. This swim training apparatus addresses the problem of increasing swimming efficiency while also teaching proper swimming technique.

In accordance with an exemplary embodiment of the present invention, there is provided a monofin swim training apparatus comprising a flexible, elongated member; and at least one fastener attached to the flexible, elongated member and configured to releasably attach the flexible, elongated member to the front of the lower legs of a user. The flexible, elongated member extends at least six inches beyond the toes of the user when attached to the front of the lower legs of the user.

In one aspect of this exemplary embodiment, the at least one fastener can releasably attach the flexible, elongated member to at least one of the user's knees, ankles, and feet. In another aspect of this exemplary embodiment, the at least one fastener may comprise a plurality of fasteners. In another aspect of this exemplary embodiment, a first plurality of securing members may be provided along a length of the flexible, elongated member for receiving the plurality of fasteners.

In one aspect of this exemplary embodiment, the apparatus may further comprise a weight attached to the flexible, elongated member. In another aspect of this exemplary embodiment, the apparatus may further comprise a second plurality of securing members provided along a length of the flexible, elongated member for receiving a plurality of fasteners and configured to selectively secure the weight at one or more positions on the flexible, elongated member. In another aspect of this exemplary embodiment, the weight may weigh from about 100 g to about 3000 g. In another aspect of this exemplary embodiment, the weight may comprise a buoyant material. In another aspect of this exemplary embodiment, the weight may be flexible.

In one aspect of this exemplary embodiment, the flexible, elongated member can have a length of about one foot to about five feet. In another aspect of this exemplary embodiment, the flexible, elongated member can have a width of about six inches to about 24 inches. In another aspect of this exemplary embodiment, the flexible, elongated member can have a thickness of about 1.5 millimeters to about 10 millimeters.

In one aspect of this exemplary embodiment, the flexible, elongated member can have a longitudinal axis and a modulus sufficient to allow the flexible elongated member to flex from the longitudinal axis by about 5° to about 110° when forced to undulate by the kicks of the user under water. In another aspect of this exemplary embodiment, the flexible, elongated member can flex by at least about 90° to about 180° without permanently deforming relative to first and second ends of the flexible elongated member.

In one aspect of this exemplary embodiment, the flexible, elongated member is fabricated from a material selected from the group consisting of polyethylene, polypropylene, polystyrene, thermoplastics, rubber, reinforced polyester, nylon, and any combination and composites thereof.

The present invention has several training advantages over previously designed inventions. Both the knees and ankles can be secured close or nearly touching to optimize power potential. During the recovery phase of the kick, the knees and ankles are substantially straight for further power optimization. With the undulation of the flexible, elongated member and the adjustable position of the weight, the propulsive phase extends beyond the user's coronal plane for a bilateral undulation. The bilateral nature of the undulation develops increased power for the recovery phase of the kick. These advantages are currently lacking in any training device in the industry.

Other features and advantages of the present invention will be apparent from the following more detailed description of the exemplary embodiments, taken in conjunction with the accompanying drawings, which illustrate, by way of example, the principles of the present invention.

BRIEF DESCRIPTION OF THE SEVERAL VIEWS OF THE DRAWINGS

The foregoing summary, as well as the following detailed description of the exemplary embodiments of the present invention, will be better understood when the appended drawings are considered in conjunction therewith. For the purposes of illustrating the invention, there are shown in the drawings exemplary embodiments. It should be understood, however, that the present invention is not limited to the precise arrangements and instrumentalities shown.

In the drawings.

DETAILED DESCRIPTION OF THE INVENTION

Reference will now be made in detail to the various aspects of the present invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms, such as top, bottom, left, right, above, below, and diagonal, are used with respect to the accompanying drawings. Such directional terms used in conjunction with the following description of the drawings should not be construed to limit the scope of the present invention in any manner not explicitly set forth. Additionally, the term "a," as used in the specification, means "at least one." The terminology includes the words above specifically mentioned, derivatives thereof, and words of similar import.

The term "about," as used herein when referring to a measurable value, such as an amount, a temporal duration, and the like, is meant to encompass variations of ±20%, ±10%, ±5%, ±1%, or ±0.1% from the specified value, as such variations are appropriate.

The term "substantially," as used herein, shall mean considerable in extent, largely but not wholly that which is specified, or an appropriate variation therefrom as is acceptable within the field of art.

Throughout this disclosure, various aspects of the present invention can be presented in a range format. It should be understood that the description in range format is merely for convenience and brevity and should not be construed as an inflexible limitation on the scope of the present invention. Accordingly, the description of a range should be considered to have specifically disclosed all the possible subranges as well as individual numerical values within that range. For example, the description of the range "from 1 to 6" should be considered to have specifically disclosed subranges, such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, and 6. This applies regardless of the breadth of the range.

Furthermore, the described features, advantages, and characteristics of the exemplary embodiments of the present invention may be combined in any suitable manner in one or more embodiments. One skilled in the relevant art will recognize, in light of the description herein, that the present invention can be practiced without one or more of the specific features or advantages of a particular exemplary embodiment. In other instances, additional features and advantages may be recognized in certain embodiments that may not be present in all exemplary embodiments of the present invention.

Figure 1:
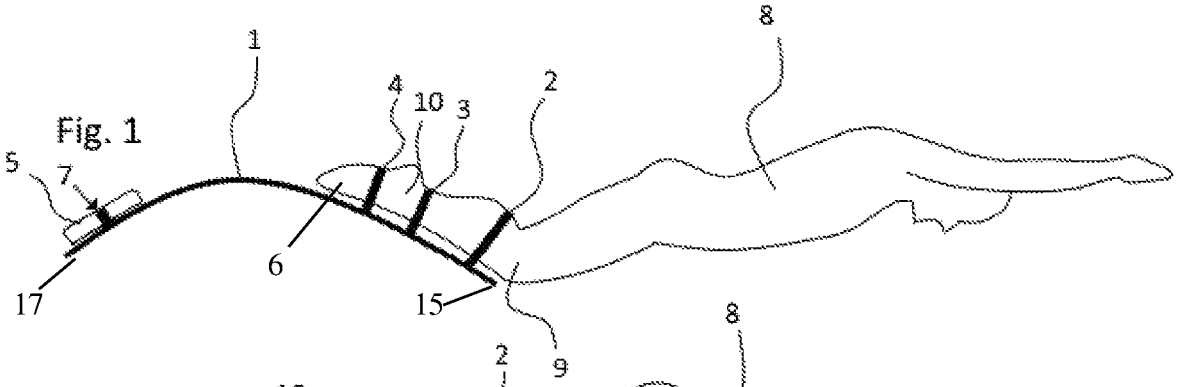
FIG. 1 is a side view of a swim training apparatus, including a user in the process of finishing a recovery phase of undulation, in accordance with an exemplary embodiment of the present invention.
Figure 2:
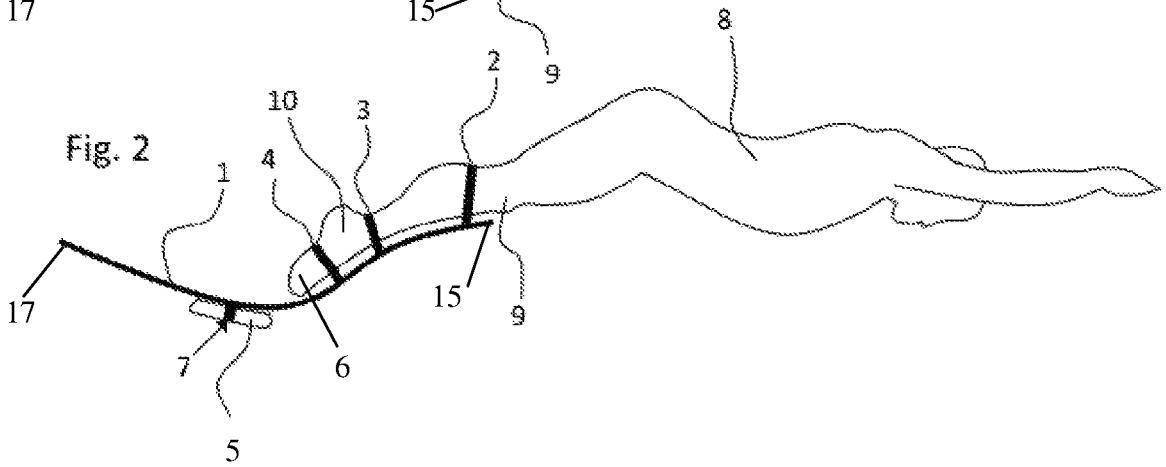
FIG. 2 is a side view of a swim training apparatus, including a user in the process of finishing a propulsive phase of undulation, in accordance with an exemplary embodiment of the present invention.

Referring now to the drawings, FIG. 1 illustrates a user in the process of finishing a recovery phase of undulation and/or starting a propulsive phase while using an exemplary embodiment of the present invention. FIG. 2 illustrates a user in the process of finishing a propulsive phase of undulation and/or starting a recovery phase while using this exemplary embodiment of the present invention.

Figure 3:
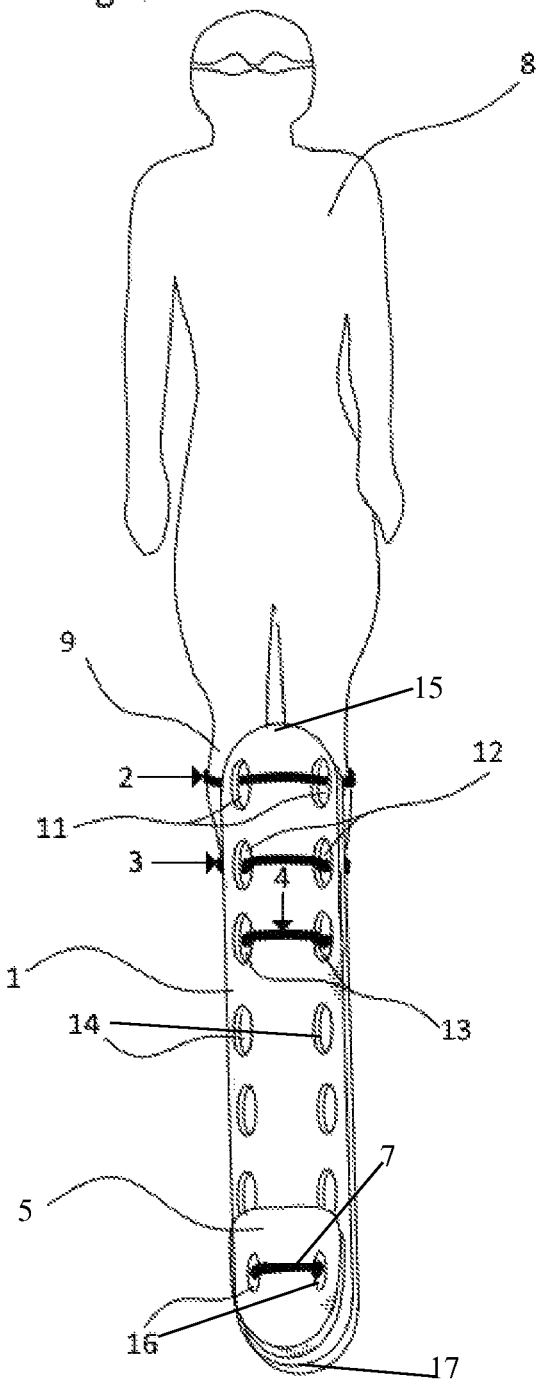
FIG. 3 is a front view of a swim training apparatus, including a user, in accordance with an exemplary embodiment of the present invention.

In accordance with an exemplary embodiment of the present invention, the monofin swim training apparatus comprises a flexible, elongated member 1, fasteners 2, 3, 4, and 7, securing members 11, 12, 13, and 14, as referenced in FIG. 3. As described in greater detail below, a weight 5 can be adjustably attached to the flexible, elongated member 1 via fastener 7, securing member 14 and a securing member 16 provided in the weight 5. In this exemplary embodiment, the flexible, elongated member 1 is secured near or at a first end 15 to the front of the lower legs of a user 8 with fastener 2 at or near the user's knees 9, fastener 3 at or near the user's ankles 10, and fastener 4 at the user's feet 6. The securing members themselves can include an opening, or a series of openings, extending through and along the flexible, elongated member and the weight. It is appreciated by those skilled in the art that, while the figures show securing members 11, 12, 13, and 14 along the edges of the elongated member 1, they are not necessarily limited as such. Specifically, the securing members 11, 12, 13, and 14 can be located anywhere along the length and width of the flexible, elongated member 1, including in the center.

In an exemplary embodiment of the invention, the monofin swim training apparatus can be affixed to both legs of the user. In one exemplary embodiment, the flexible, elongated member is affixed to the user in such a way that the user's knees are in a substantially fixed position relative to each other.

Examples of suitable fasteners for use in accordance with the present invention include, but are not limited to, straps, tethers, rope, tubing, hooks and latches, elastic cords, and other strapping mechanisms. Additionally, other fasteners could include any structure that wraps around the legs of user 8 and attaches the flexible, elongated member 1 to the front of the user's lower legs. These structures can include pockets or holes configured to receive a user's feet 6, ankles 10, and/or knees 9 and either compress around the legs of user 8, or be further secured by straps or zippers. It is appreciated that the fasteners may be elastic or inelastic, depending on the material from which they are fabricated and the structure of the fasteners. Such materials can include nylon, polyester, acrylic, rayon, and Spandex® or polymers including, but not necessarily limited to, polyethylene, polypropylene, polystyrene, thermoplastics, and so forth. Furthermore, the fasteners 2, 3, 4, and 7 can be built into the flexible, elongated member 1, e.g., built in straps or pockets, or be attachable to the flexible, elongated member 1, e.g., individual straps and holes configured to receive the straps.

The flexible, elongated member 1 is flexible and substantially planar in shape to facilitate undulation. It is appreciated, however, that the flexible, elongated member 1 may be non-planar and include grooves or ridges to facilitate undulation or for fastening or other features. The flexible, elongated member 1 can be fabricated from any suitable materials known in the art that are capable of flexing and providing enough resistance to propel a user through the water. Examples of such materials include, but are not limited to, polymers such as polyethylene, polypropylene, polystyrene, thermoplastics, rubber, reinforced polyester, nylon, and any combinations or composites thereof. In certain exemplary embodiments, the flexible, elongated member 1 is fabricated from high-density polyethylene. The flexible, elongated member 1 can have a length of about 1, 2, 3, 4, 5, or more feet. In certain exemplary embodiments, when secured to user 8, the flexible elongated member extends at least six inches to one to two feet or more beyond the toes of user 8. In certain exemplary embodiments, the width of the flexible, elongated member 1 is substantially equal to the width of both feet 6 of user 8, but can be about 6, 7, 8, 9, 10, 11, 12, 13, 14, 15, 16, 17, 18, 19, 20, 21, 22, 23, 24, or more inches wide. The thickness of the flexible, elongated member 1 can be about 1.5, 2, 3, 4, 5, 6, 7, 8, 9, 10, or more millimeters. Furthermore, the flexible, elongated member 1 can be constructed such that it can flex by at least about 90° and up to about 180°, relative to the first and second ends 15, 17 of the flexible, elongated member 1, without permanently deforming.

Additionally, an aspect of the exemplary embodiment of the present invention is that the flexible, elongated member 1 can be configured to flex, relative to a longitudinal axis of the flexible, elongated member 1, in the anterior and posterior directions when subjected to undulation forces by a user 8 underwater. In certain exemplary embodiments, the flexible, elongated member 1 is configured to flex by up to 90°. In certain other exemplary embodiments, the flexible, elongated member 1 is configured to flex by about 10° to 75°. In yet certain other exemplary embodiments, the flexible, elongated member 1 is configured to flex by about 15° to 45°. However, it is appreciated by those skilled in the art that the flexible, elongated member 1 can be configured to be able to flex by any number of degrees, including, but not limited to, by about 10°, 15°, 20°, 25°, 30°, 35°, 45°, 50°, and greater. In other words, the flexible, elongated member 1 can have a stiffness or modulus sufficient to allow it to flex, relative to a longitudinal axis thereof, by about 5°, 10°, 15°, 200, 25°, 30°, 35°, 45°, 50°, 55°, 60°, 65°, 70°, 75°, 80°, 85°, 90°, 95°, 100°, 105°, and 110° when forced to undulate from the kicks of a user 8 under water. In certain exemplary embodiments, the flexible, elongated member 1 is configured to have a stiffness or modulus such that it flexes by about 75° to 100° when undulated underwater during normal use.

It is appreciated by those skilled in the art that, while the flexible, elongated member 1 can be substantially planar, it is not necessarily limited as such. For example, the flexible, elongated member 1 can have ridges, grooves, fins, or other features configured to engage the user 8, like a fin extending between and/or around the knees 9, ankles 10, and feet 6 of user 8. Additionally, the flexible, elongated member 1 can have built in fasteners 2, 3, 4, and 7, such as, for example, straps whereby the knees 9, ankles 10, and feet 6 of user 8 can be secured to the flexible, elongated member 1. Furthermore, it is also appreciated that the flexible, elongated member 1 can be molded into different shapes and sizes to fit to the feet 6, ankles 10, or knees 9 of user 8. Additionally, the flexible, elongated member 1 can be constructed as a unitary piece, including the fasteners 2, 3, and 4 and weight 5.

The weight 5 can be secured to the flexible, elongated member 1 with a fastener 7 to further facilitate the undulation of the flexible, elongated member 1. As described above, fastener 7 can be in the form of any suitable fastener including, but not limited to, straps. In reference to FIG. 1, the weight 5 can be affixed to a second end 17 away from the first end 15. In reference to FIG. 2, the weight 5 can also be affixed somewhere between the first end 15 and the second end 17. In certain exemplary embodiments, the weight 5 is secured somewhere below the feet 6 of user 8 by fastener 7.

While the user kicks, the weight 5 assists the flexible, elongated member 1 to undulate to both sides of the user's body, i.e., anterior and posterior. However, it is appreciated that the weight is not a necessary component to enable undulation. Additionally, it is appreciated that the weight assists the user to feel the movement of the flexible, elongated member and promote the user to wait for it to fully extend forward before the user begins undulation in the opposite direction.

In certain exemplary embodiments, the weight 5 can be fabricated from Acrylonitrile Butadiene Styrene (ABS). However, the weight 5 may also be fabricated from, or include in its configuration, any other suitable material known in the art, such as, but not limited to, other polymers, such as ultra-high-molecular-weight polyethylene (UHMWPE), high-density polyethylene (HDPE), polypropylene, polystyrene, other types of thermoplastics, metals, and composites or combinations thereof. Furthermore, in certain exemplary embodiments, the weight 5 can be configured to be secured to the flexible, elongated member 1 such that it is substantially planar with, and flush with the edges of, the flexible, elongated member 1. This can be accomplished by using the fasteners described above, including straps and sliding guides, being integrally formed with the flexible, elongated member 1 and/or placing the weight 5 in a cavity inside the flexible, elongated member 1. Alternatively, the weight 5 can be configured such that, while the weight 5 is affixed to the flexible, elongated member 1, it is still slidable along the length of the flexible, elongated member 1 up to the knees 9 of user 8. For example, the weight may be mounted within a housing or cavity or to a rail or guide that forms a path about which the weight 5 traverses. In this example, the weight 5 can be configured to move along the flexible, elongated member during undulation thereof or may instead be affixed by way of a fastener, e.g., a push pin. Furthermore, the weight may alternatively be configured to be flexible. For instance, the weight 5 can be fabricated from lead shot or molded malleable lead, such as at least one bag of coated lead shot.

Additionally, the weight 5 can be made or adjusted to be neutrally buoyant. For example, the weight 5 may be constructed to include trapped gas to add a certain level of buoyancy to the weight 5. Alternatively, the weight 5 may be configured to include materials such as Styrofoam, inflatable substances or structures, fiberglass, wood, rubber, and so forth to aid in buoyancy.

Referring now to FIG. 3, a front view of an exemplary embodiment according to the present invention in use is illustrated. There, the flexible, elongated member 1 is affixed to the front of the legs of user 8 by means of fasteners 2, 3, and 4. In this exemplary embodiment, the fastener 2 affixing the flexible, elongated member 1 to the knees 9 of user 8 comprises a strap affixed around the knees 9 and through the securing member 11. Similarly, fasteners 3, 4 for the ankles 10 and feet 6 are affixed around the user 8 and secured through the securing members 12 and 13.

It is appreciated that securing members 11, 12, and 13 may be integrally formed with the flexible, elongated member 1 or may be structures extending from the flexible, elongated member 1. Examples of such securing members include, but are not limited to, pairs of openings, hooks, grooves, latches, tie backs, screws, or any other such means capable of securing, or being secured, to another body or structure.

In one exemplary embodiment, the weight 5 can be attached at the second end 17 of the flexible, elongated member 1 farthest from the user 8, as shown in FIG. 1. In another exemplary embodiment, weight 5 can be attached to the flexible, elongated member 1 between the first end 15 and the second end 17, as shown in FIG. 2. The weight 5 can be secured to the flexible, elongated member 1 with a fastener 7 that goes around both the weight 5 and the flexible, elongated member 1 by way of the securing member 16 in the weight 5 and the securing member 14 along the flexible, elongated member 1. The securing members 14 can be spaced along a longitudinal length of the flexible, elongated member 1 such that the weight 5 can be secured in one of a plurality of positions. It is appreciated that securing members 14 and 16 may be the same as or different from those described in reference to securing members 11, 12, and 13 above.

Figure 4:
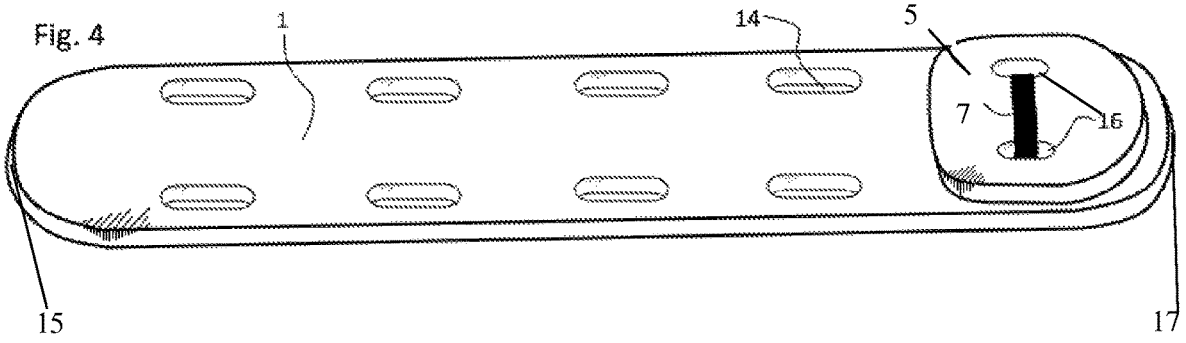
FIG. 4 is a top perspective view of a swim training apparatus in accordance with an exemplary embodiment of the present invention.

Referring now to FIG. 4, the flexible, elongated member 1 has the plurality of securing members 14 and the securing members 16 of the weight 5 for securing the weight 5 to the elongated member with the fastener 7 at different positions. The benefit of positioning the weight 5 at varying positions is to increase the tempo of undulation. As the weight 5 gets closer to the feet 6 of the user 8, the undulations become faster. As the weight is positioned closer to the feet, the rate of undulation of the flexible, elongated member increases in cycles per unit of time. The industry accepts a scientifically proven undulation cycle as between 0.40 and 0.45 seconds per complete kick cycle. When the weight is positioned near or substantially at the end of the user's feet, the flexible, elongated member undulates at nearly this accepted scientific rate while the user is kicking under water. Conversely, as the weight 5 gets further from the feet 6 of the user 8, the undulations become slower.

It is appreciated that the weight can be as light as about 100 g or as heavy as about 3000 g. Suitable weights for the weight 5 include, but are not limited to, 200, 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800 and 2900 g or more grams.

The exemplary embodiments of the present invention thus far described pertain to a situation wherein the flexible, elongated member 1 is attached to the front of the lower legs of the user. It is understood, however, that the invention is not so limited. That is, the flexible, elongated member 1 can be attached by the aforementioned fasteners 2, 3 and/or 4 to the rear of the lower legs of an able-bodied user or the front or rear of the of the thighs of a handicapped user whose lower legs are missing from substantially at or below the knees.

While the present invention has been described with reference to exemplary embodiments, it will be appreciated by those skilled in the art that various changes may be made and equivalents may be substituted for elements thereof without departing from the scope of the present invention. In addition, modifications may be made to adapt a particular situation or material to the teachings of the present invention without departing from the essential scope thereof.

It is to be understood, therefore, that the present invention not be limited to the particular aspects disclosed, but it is intended to cover modifications within the spirit and scope of the subject disclosure, as defined by the appended claims.

We claim:

1. A monofin swim training apparatus comprising:

a flexible, elongated member;

a first fastener attached to the flexible, elongated member and configured to releasably attach the flexible, elongated member to the legs of a user; and a second fastener longitudinally spaced from the first fastener along a longitudinal axis of the flexible, elongated member, and attached to the flexible, elongated member, wherein the flexible, elongated member extends beyond the toes of the user when attached to the legs of the user.

2. The monofin swim training apparatus of claim 1, wherein the flexible, elongated member extends at least six inches beyond the toes of the user when attached to the legs of the user.

3. The monofin swim training apparatus of claim 1, further comprising a first plurality of securing members each spaced along a longitudinal length of the flexible, elongated member for receiving a respective first or second fastener.

4. The monofin swim training apparatus of claim 3, wherein the first and second fasteners are attached to a proximal end of the flexible, elongated member, and wherein the monofin swim training apparatus further comprises a weight attached to a distal end of the flexible, elongated member.

5. The monofin swim training apparatus of claim 4, further comprising a second plurality of securing members each spaced along a longitudinal length of the flexible, elongated member for receiving a respective first or second fastener, and configured to selectively secure the weight at one or more positions on the flexible elongated member about its distal end.

6. The monofin swim training apparatus of claim 4, wherein the weight weighs from about 100 g to about 3000 g.

7. The monofin swim training apparatus of claim 4, wherein the weight comprises a buoyant material.

8. The monofin swim training apparatus of claim 4, wherein the weight is flexible.

9. The monofin swim training apparatus of claim 4, wherein the weight comprises at least one bag of lead shot.

10. The monofin swim training apparatus of claim 4, wherein the flexible elongated member flexes sufficiently to produce an undulation cycle of between 0.40 and 0.45 seconds per complete kick cycle is produced in the flexible, elongated member during kicking by the user under water.

11. The monofin swim training apparatus of claim 4, wherein the weight is movable along a length of the flexible, elongated member.

12. The monofin swim training apparatus of claim 1, wherein the flexible, elongated member has a substantially uniform width along its entire longitudinal length.

13. The monofin swim training apparatus of claim 1, wherein the flexible, elongated member has a thickness of about 1.5 millimeters to about 10 millimeters.

14. The monofin swim training apparatus of claim 1, wherein the flexible, elongated member has a modulus sufficient to allow the flexible elongated member to flex about 5° to about 110° from its longitudinal axis when undulated by the kicks of the user under water.

15. The monofin swim training apparatus of claim 1, wherein the flexible, elongated member can flex by at least about 90° to about 180° from its longitudinal axis without permanently deforming.

16. The monofin swim training apparatus of claim 1, wherein the flexible, elongated member is fabricated from a material selected from the group consisting of polyethylene, polypropylene, polystyrene, thermoplastics, rubber, reinforced polyester, nylon, and any combination and composite thereof.

17. A monofin swim training apparatus comprising:

a flexible, elongated member; and at least one fastener attached to the flexible, elongated member and configured to releasably attach the flexible, elongated member to the legs of a user, wherein the flexible, elongated member has a longitudinal axis and a modulus sufficient to allow the flexible elongated member to flex from the longitudinal axis by about 5° to about 110° when undulated by the kicks of the user under water.

18. A monofin swim training apparatus comprising:

a flexible, elongated member;

at least one fastener attached to the flexible, elongated member and configured to releasably attach the flexible, elongated member to the legs of a user, wherein the flexible, elongated member can flex by at least about 90° to about 180° relative to first and second ends of the flexible elongated member without permanently deforming.

* * * * *